US005429243A

United States Patent [19]

Woelk et al.

[11] Patent Number: 5,429,243

[45] Date of Patent: Jul. 4, 1995

[54] PACKAGING BOX FOR ELONGATED OBJECTS

[75] Inventors: Steffen Woelk, Viersen; Manfred Hermann, Korb; Eberhard Krieger, Weinstadt; Guenter Loew, Waiblingen, all of Germany

[73] Assignee: Robert Bosch GmbH, Stuttgart, Germany

[21] Appl. No.: 167,106

[22] Filed: Dec. 15, 1993

[30] Foreign Application Priority Data

Dec. 15, 1992 [DE] Germany ..... 9217040 U

[51] Int. Cl.[6] ..... B65D 85/42; B65D 25/04

[52] U.S. Cl. ..... 206/538; 206/232; 206/443; 220/531; 229/120.26; 229/120.29; 229/120.31

[58] Field of Search ..... 206/528, 530, 539, 538, 206/232, 443, 446; 229/120.36, 120.25, 120.26, 120.27, 120.29, 120.31, 120.38; 220/507, 531

[56] References Cited

U.S. PATENT DOCUMENTS

| | | | |
|---|---|---|---|
| Re. 25,073 | 10/1961 | Phillips | 229/120.27 X |
| 1,268,920 | 6/1918 | Bots | 206/538 X |
| 1,648,565 | 11/1927 | Primley | 206/232 X |
| 2,013,240 | 9/1935 | Harvey | 229/120.26 X |
| 2,335,490 | 11/1943 | Deline | 229/120.27 X |
| 2,626,077 | 1/1953 | Marshall | 229/120.27 X |
| 2,644,259 | 7/1953 | Beadle | 206/534 X |
| 2,767,532 | 10/1956 | Bossi | 206/538 X |
| 3,721,335 | 3/1973 | Grant | 229/120.36 X |
| 3,845,898 | 11/1974 | Hackenberg | 229/120.26 X |
| 3,921,895 | 11/1975 | Ziche | 206/528 X |
| 3,937,391 | 2/1976 | Focke | 229/120.27 X |
| 4,094,454 | 6/1978 | Snyder | 229/120.36 X |
| 4,186,835 | 2/1980 | Hofer | 206/443 |
| 5,103,972 | 4/1992 | Ackeret | 206/232 |

FOREIGN PATENT DOCUMENTS 0441757 8/1991 European Pat. Off. .

*Primary Examiner*—Byron P. Gehman

*Attorney, Agent, or Firm*—Edwin E. Greigg; Ronald E. Greigg

[57] ABSTRACT

A packaging box for receiving a plurality of fragile elongated objects, such as small bottles, ampoules or the like, has a compartmented insert with at least one partition. To enable additionally accommodating a brochure in the folding box in a readily visible and accessible manner, a separate wall is disposed parallel to one broad side wall of the folding box; the partitions adjoin this separate wall, which together with the one broad side wall forms a pocket for receiving the folded brochure.

4 Claims, 1 Drawing Sheet

PACKAGING BOX FOR ELONGATED OBJECTS

BACKGROUND OF THE INVENTION

The invention relates to a packaging box for a plurality of elongated objects, such as small bottles, ampoules, vials or the like.

A folding box, known for instance from published European application no. EP-A-441 757, has a compartmented insert with a plurality of partitions that form chambers for the individual ampoules in order to protect the packaged glass ampoules against breakage. For many packaged substances it is important, and for medicines it is indispensable, that the medicines be accompanied by instructions for use in the form of a folding slip or brochure. If only one object is packed in each folding box, then the folded slip is wrapped in the shape of a letter U around the object and accommodated in the folding box. In multiple-item packages with a compartmented insert this arrangement is difficult. A packaging box for a plurality of elongated objects in which an accompanying text can also be accommodated simply and readily accessibly is therefore needed.

OBJECT AND SUMMARY OF THE INVENTION

It is an object of the packaging box according to the invention, to provide the advantage that without major effort or expense, a separate repository for the accompanying text, in the form of a folding slip or brochure, is present. Moreover, with this arrangement, the accompanying text is immediately visible when the packaging box is opened and can be removed easily and separately from an object, and equally easily and safely accommodated in the box again after use.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
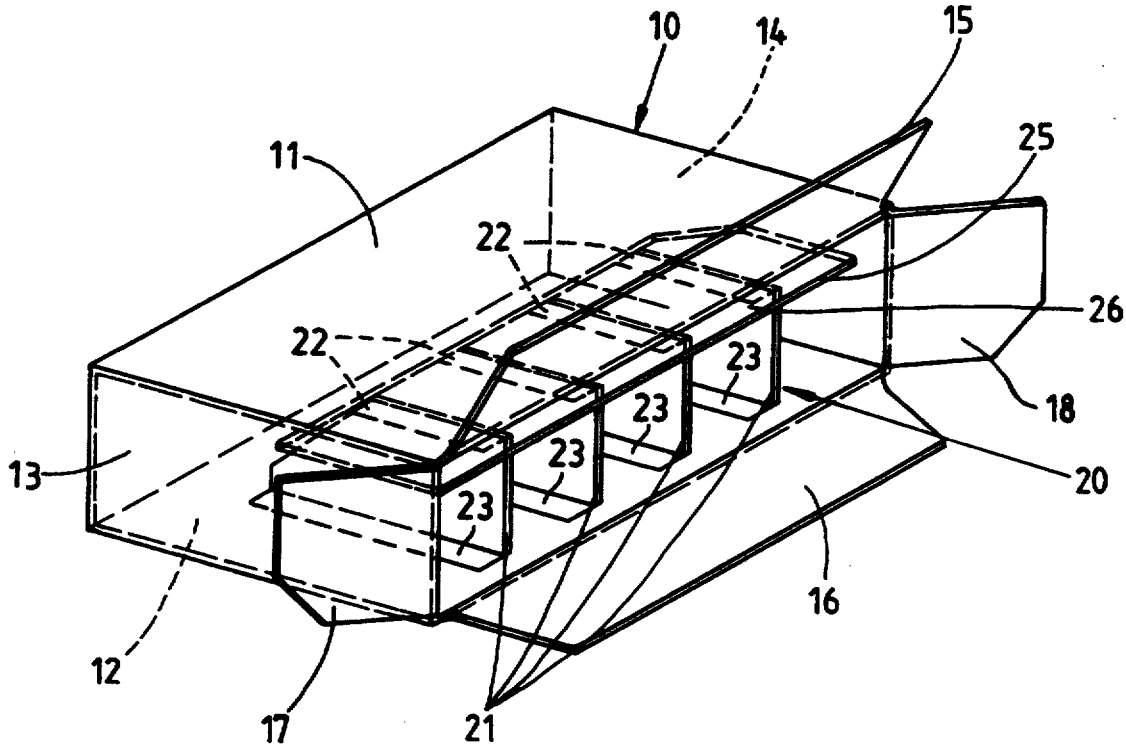
FIG. 1 shows a folding box with a compartmented insert, open on one end, in a perspective view.
Figure 2:
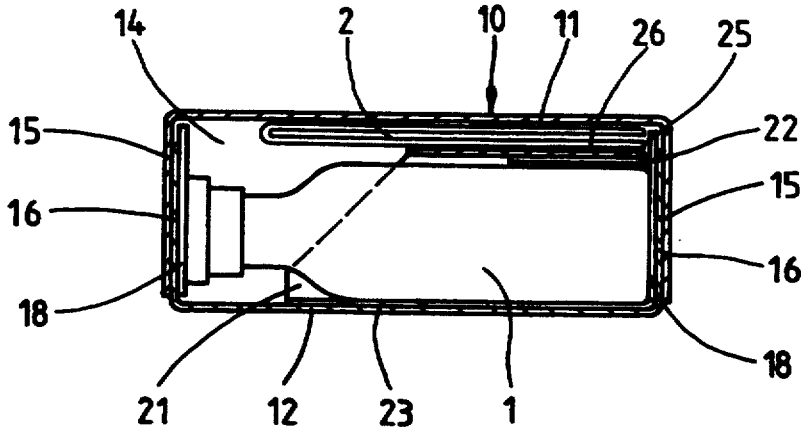
FIG. 2 shows the folding box of FIG. 1 in a longitudinal section.

FIG. 1 depicts a block-shaped folding box made of cardboard or pasteboard having a body 10 with two parallel broad side walls 11, 12 and two parallel narrow side walls 13, 14, as well as closure tabs 15 to 18 pivotably joined to these side walls for closing the openings of the body 10 in a known manner. The folding box as shown in FIG. 1 has one closed and one non-closed opening.

The folding box, intended for packaging a plurality of fragile objects 1, for instance 5 of them, such as bottles, ampoules, vials or the like, has a compartmented insert 20, to prevent the objects 1 from striking one another, with a plurality of partitions 21, for instance four in number, which extend in planes that are parallel to the narrow side walls 13, 14 and each divide off one compartment for each object 1. For accommodating an accompanying text in the form of a folded slip 2, the folding box additionally has a separator or partition which forms an inner wall 25 of cardboard or pasteboard, which extends transversely to the partitions 21 and parallel to the broad side walls 11, 12. The inner wall extends parallel to and at a distance of 2 to 5 mm from one of the two broad side walls 11, 12 [( 11 ) in the drawing] and extends over the entire length of the folding box. The inner wall forms a shelf 26 which together with the broad side wall 11 near it, forms a pocket for receiving the folded slip 2.

The partitions 21 are joined to one surface face of the inner wall 25 and to the one broad side wall 12 that defines the compartments by means of pivotably connected tabs 22, 23. The wall 25 and the partitions 21 extend over only a portion of the depth of the folding box, so that the objects 1 and the folded slip 2 are disposed readily visible and can be grasped without hindrance from the side opened for use. The partitions 21 are preferably made to slope toward the inner wall 25.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A packaging box for a plurality of elongated objects, said packaging box having two broad side walls, two narrow side walls, and two end openings which are closed by end closure tabs, and having a plurality of partitions forming compartments aligned parallel to the narrow side walls, the partitions extending from one side of an inner wall (25) provided in a plane spaced from and parallel to one of the two broad side walls (11, 12) and the partitions extending across the width of said packaging box between said inner wall and the other of said two broad side walls, said inner wall being adjoined by each partition (21) and together with said one broad side wall forms an open pocket means between said one broad side wall and said inner wall for receiving at least one differently shaped elongated object, and each partition (21) is pivotably joined to one side of said inner wall (25).

2. A packaging box as defined by claim 1, in which the inner wall (25) extends over a portion of the depth of the box.

3. A packaging box as defined by claim 2, in which said box comprises a folding box.

4. A packaging box as defined by claim 1, in which said box comprises a folding box.

* * * * *